US005510759A

United States Patent [19]

Gula et al.

[11] Patent Number: 5,510,759

[45] Date of Patent: Apr. 23, 1996

[54] MINIATURE CIRCUIT BREAKER WITH GROUND FAULT ELECTRONICS SUPPORTED BY STIFF CONDUCTORS FOR EASY ASSEMBLY

[75] Inventors: Lance Gula, Clinton; Michael J. Whipple, Oakdale, both of Pa.

[73] Assignee: Eaton Corporation, Cleveland, Ohio

[21] Appl. No.: 264,559

[22] Filed: Jun. 23, 1994

[51] Int. Cl.[6] ..... H01H 73/00

[52] U.S. Cl. ..... 335/18; 335/202

[58] Field of Search ..... 335/18, 202, 132, 335/131; 361/42–50

[56] References Cited

U.S. PATENT DOCUMENTS 3,566,318 2/1971 Gelzheiser et al. .

3,999,103 12/1976 Misencik et al. .

5,260,676 11/1993 Patel et al. .

5,414,395 5/1995 Garnto et al. ..... 335/18

*Primary Examiner*—Lincoln Donovan

*Attorney, Agent, or Firm*—Martin J. Moran

[57] ABSTRACT

A miniature ground fault circuit breaker having a housing assembled from molded sections has stiff conductors supporting the toroidal coils of the ground fault circuit in position in one molded section and aligning connectors secured to the stiff conductors for easier assembly of the molded housing sections.

8 Claims, 8 Drawing Sheets

FIG..2
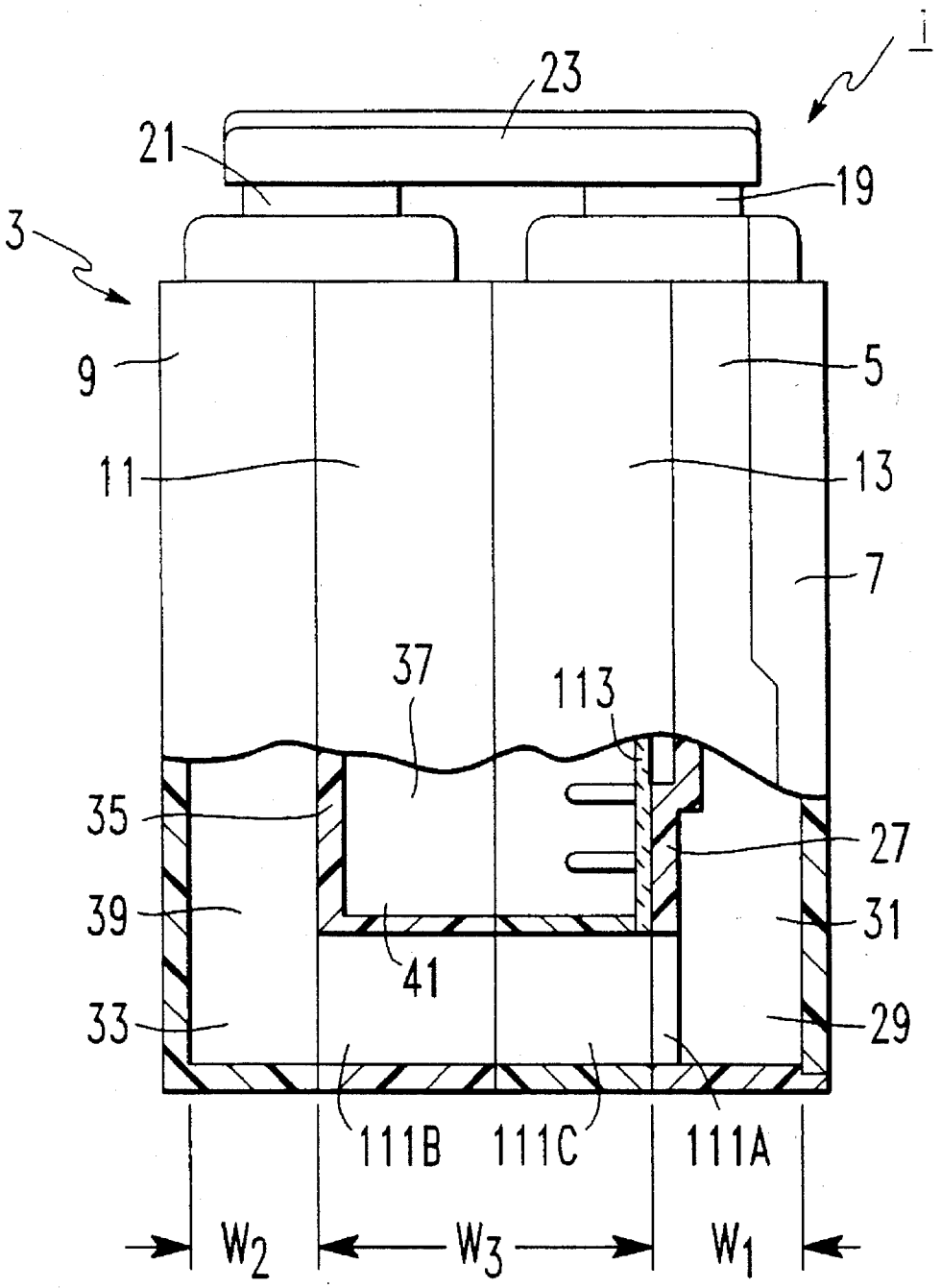

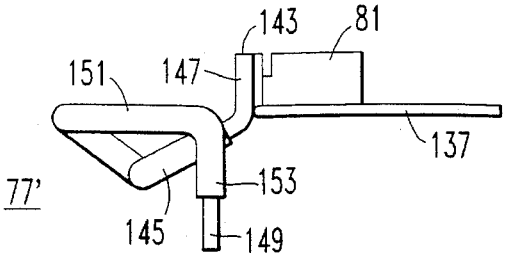
FIG. 8
FIG. 9
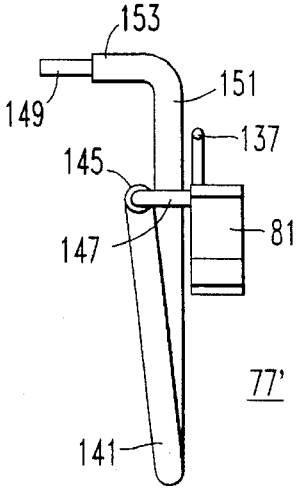
FIG. 7
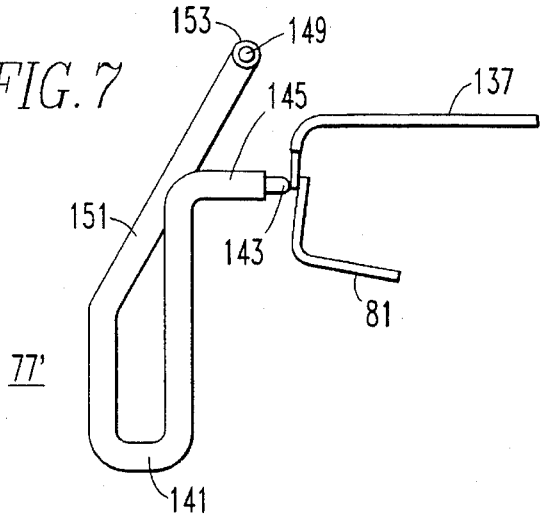
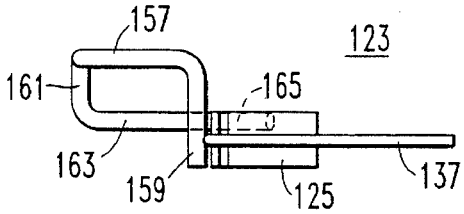
FIG. 11
FIG. 10
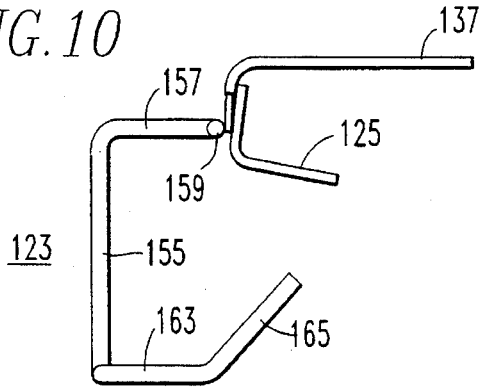
FIG. 12
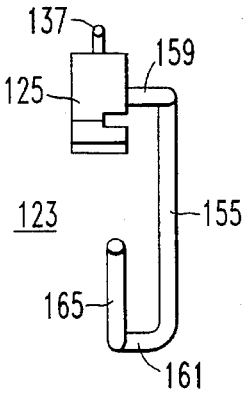

MINIATURE CIRCUIT BREAKER WITH GROUND FAULT ELECTRONICS SUPPORTED BY STIFF CONDUCTORS FOR EASY ASSEMBLY

CROSS-REFERENCE TO RELATED APPLICATIONS

Commonly owned, concurrently filed applications entitled "Two-Pole Compartmentalized Ground Fault Miniature Circuit Breakers with a Single Central Electronics Compartment" by Michael J. Whipple, Melvin A. Carrodus, Robert D. Bradley, and Gary Theodore, Ser. No. 08/264,571 filed on Jun. 23, 1994, and entitled "Two-Pole Compartmentalized Ground Fault Miniature Circuit Breaker with Increased Current Rating" by Joseph P. Fello and Michael J. Whipple, Ser. No. 08/264,572, filed on Jun. 23, 1994.

BACKGROUND OF THE INVENTION

1. Field of the Invention

This invention relates to small circuit breakers with a housing assembled from molded sections forming compartments for mechanical poles and ground fault electronics. More particularly, it relates to a configuration of such circuit breakers which simplifies assembly of the molded sections and interconnection of the electronics and the mechanical poles.

2. Background of Information

Circuit breakers used in residential and light commercial installations are referred to as miniature circuit breakers. Such circuit breakers have molded insulative housings of standard dimensions sized to interchangeably plug into or bolt onto the hot stabs in a load center or panel board. Two-pole miniature circuit breakers incorporate two trip devices in a common housing which occupies two adjacent positions in the load center or panel board.

Examples of a two-pole miniature circuit breaker are provided in U.S. Pat. No. 3,999,103 ('103 patent) and U.S. Pat. No. 5,260,676 ('676 patent). As is typical for miniature circuit breakers, the two-pole breakers of these patents utilizes thermal-magnetic trip devices to provide overload and short circuit trip functions for the protected circuits. These circuit breakers also include an electronic circuit which provides ground fault protection.

The housings for the two-pole ground fault circuit breakers of the '103 and '676 patents essentially comprise two single pole breaker housings bolted together. Each half includes two stacked molded trays forming side-by-side compartments and a cover for the open compartment. The thermal-magnetic trip unit for the pole is mounted in one compartment and part of the circuits for ground fault protection is provided in the other compartment. With the two halves bolted together, the two mechanical poles are separated by one of the electronic compartments. The '676 patent suggests a single, double sized electronic compartment as an alternative, but provides no hint of how that would be implemented.

In the '103 patent most of the ground fault protection circuit is provided in the electronic compartment between the two magnetic poles including a toroidal sensing coil. However, separate trip solenoids are provided for each pole and are located in the respective electronic compartments. These trip solenoids have a lever on the plunger which extends through an opening in the partition between the mechanical pole and the electronic compartment and which engages the thermalmagnetic device to trip the pole.

The '676 patent utilizes a ground fault circuit providing neutral to ground as well as line to ground fault protection. The circuit used requires two toroidal coils which occupy the electronic compartment between the two mechanical pole compartments. The remainder of the electronic circuitry, including a single trip solenoid with separate windings for the two poles, is located in the other electronic compartment.

This splitting of the electronic trip circuit as described in both the '103 and '676 patents necessitates the routing of wires between the two electronic compartments in addition to the routing of wires from the mechanical poles to the electronic compartments. This complicates the task of assembling the two pole ground pole fault circuit breaker. In addition, the widths of the two electronic compartments are limited. This limited width dictated that the toroidal coils in the '676 patent, and the output transformer in the '103 patent used in the ground fault circuit had to be mounted with their central axes crosswise within the main electronic compartment.

The improved two-pole ground fault circuit breaker described in the above cross-referenced application identified by Ser. No. 08/264,571, has a housing made of molded sections forming a single large electronics compartment. This single compartment is formed by three separate molded sections. Inserting the electronics and maintaining them in proper orientation while the circuit breaker is assembled is not easy.

There is a need therefore, for an improved two-pole circuit breaker and an electronic trip device which is economical and easy to assemble.

This need is even more pronounced in such a circuit breaker in which all the electronics are housed in a single electronic compartment which is formed by the assembly of multiple molded housing sections.

SUMMARY OF THE INVENTION

These needs and others are satisfied by the invention which is directed to a circuit breaker having a molded housing with compartments and which is assembled from a plurality of molded housing sections. Electronic trip means are received in an electronic compartment formed by the molding housing sections. In order to simplify and speed the assembly of the circuit breaker, stiff conductor means secured at one end to one molded housing section engage and hold the electronic trip means in a fixed position with respect to the one molded housing section while the plurality of molded housing sections are assembled.

More particularly, the one end of the stiff connector means is secured to the one molded housing section by connection to a connector which is snugly engaged in a connector recess in the one molded housing section. Also, more particularly, the electronic trip means includes toroidal coil means and the stiff conductor means passes through the toroidal coil means and is configured to hold the toroidal means in the fixed position. Preferably, the first stiff conductor is configured with a bight and the toroidal coil is held in the bight.

The toroidal coils are seated in a recess in a first side of one molded housing section. The one end of the first stiff conductor extends through and opening in the one molded housing section to engage the connector seated in a recess in the second side of the one molded housing section.

The molded housing includes a mechanical pole compartment next to the electronic compartment in which a thermal-magnetic mechanical pole is housed. A conductor connected to the mechanical pole extends through an opening between the mechanical pole compartment and the electronics compartment. The second end of the stiff conductor provides a stable point to which the conductor from the mechanical pole can be brazed or soldered. A second stiff conductor also passes through the toroidal coil means and helps to support it. One end of this neutral conductor is received into a molded groove in the one section of the molded housing and the other end is bent to be in position to engage a second connector received in a recess formed in the molded housing during assembly.

The stiff conductors retain the toroidal coil means in place while the molded sections of the housing are being assembled and the wires are being connected. They also form stable connection points for the wiring.

BRIEF DESCRIPTION OF THE DRAWINGS

A full understanding of the invention can be gained from the following description of the preferred embodiments when read in conjunction with the accompanying drawings in which:

FIG. 2 is an end view with parts cut away of the circuit breaker of FIG. 1.

FIG. 7 is a front elevation view of one of the stiff conductors in accordance with the invention which forms part of the circuit breaker shown in FIGS. 1–4.

FIG. 8 is a top plan view of the stiff conductor shown in FIG. 7.

FIG. 9 is a side elevation view of the stiff circuit breaker shown in FIGS. 7 and 8.

FIG. 10 is a front elevation view of a second stiff conductor in accordance with the invention.

FIG. 11 is a top plan view of the stiff conductor of FIG. 10.

FIG. 12 is a side elevation view of the stiff conductor of FIGS. 10 and 11.

DESCRIPTION OF THE PREFERRED EMBODIMENTS

Figure 1:
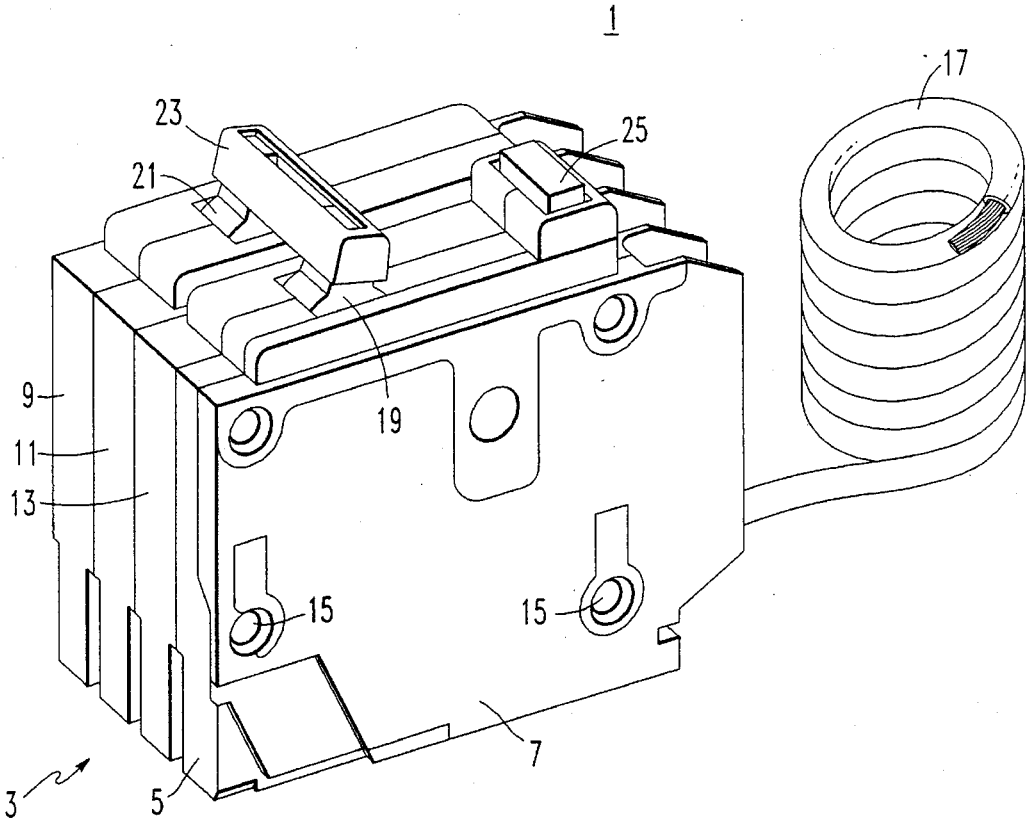
FIG. 1 is an isometric view of a two-pole, ground fault circuit breaker incorporating the invention.

Referring to FIG. 1, a two-pole ground fault circuit breaker 1 in accordance with the invention comprises a housing 3. The housing 3 is molded in sections from an electrically insulating material such as a thermal setting resin. The sections of the housing 3 include: a top base 5, a top cover 7, a bottom cover 9, a bottom base 11, and a hollow center base 13, all secured together such as by rivets 15. As shown in FIG. 1, a pigtail 17 connects a neutral conductor within the circuit breaker to a neutral bar (not shown) in a load center (not shown) in which the circuit breaker 1 may be mounted. Each of the poles of the circuit breaker 1 has an operating handle 19 and 21 which may be operated in unison by the handle tie 23. In addition, the operation of the ground fault circuit of the circuit breaker 1 can be tested by depressing the test button 25.

Figure 3A:
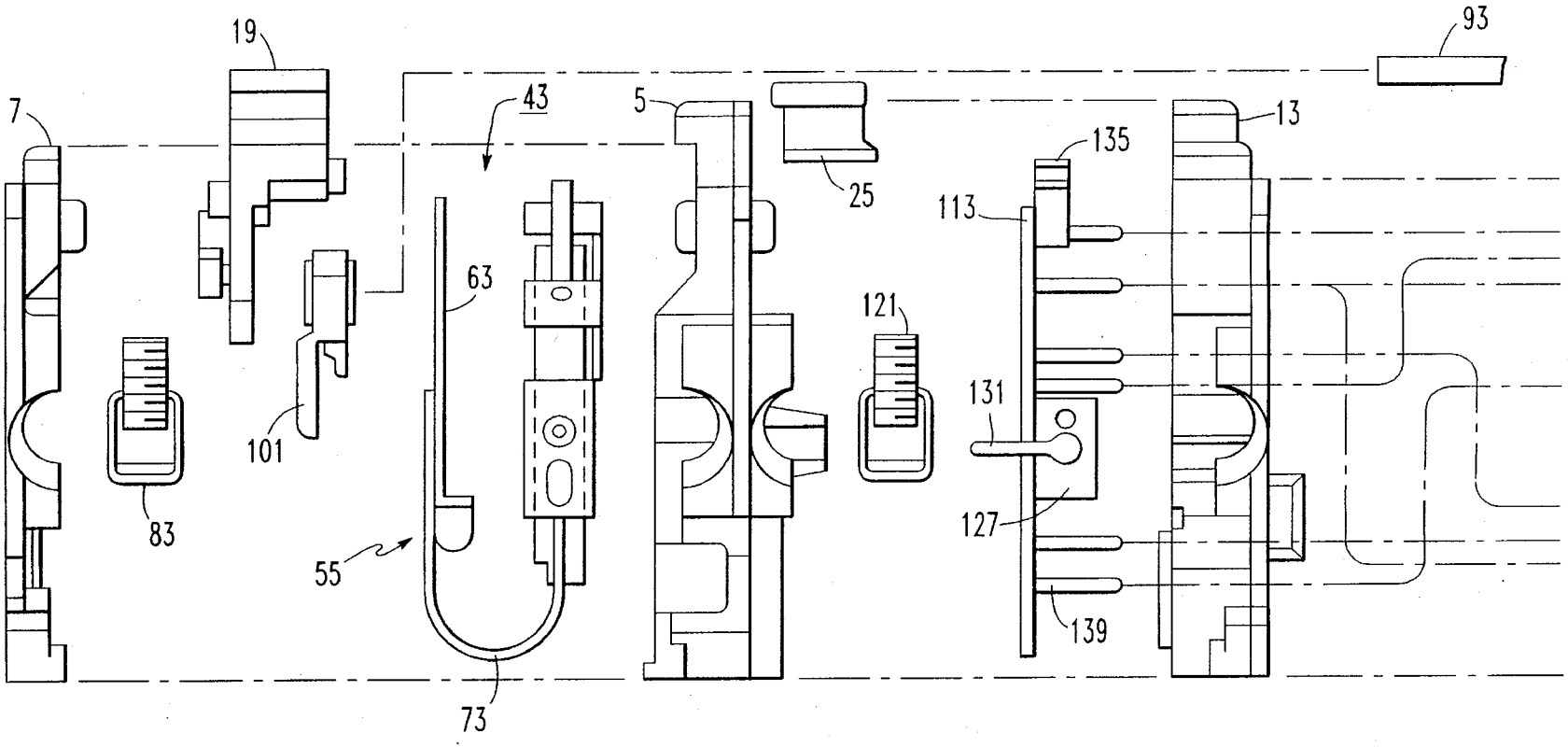
FIGS. 3A and 3B when placed side by side illustrate an exploded end view of the circuit breaker of FIG. 1.
Figure 3B:
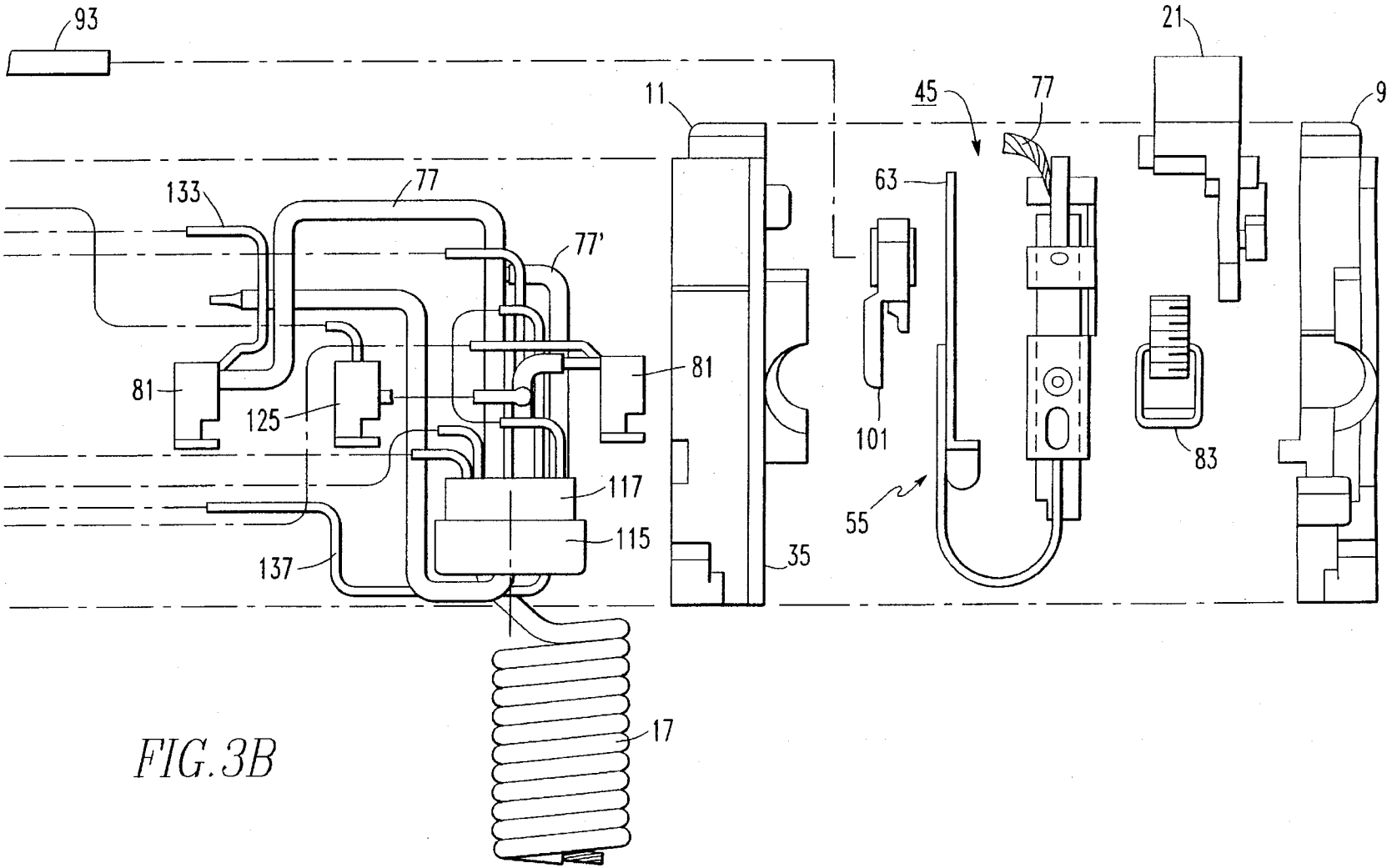

Turning to FIGS. 2 and 3A and 3B, it can be seen that the top base 5 forms a partition 27 which serves as a wall of a first cavity 29. Within the cavity 29 are various molded elements which as will be seen support the mechanism of the first pole. The top cover 7, mates with the top base 5 to enclose the cavity 29, thereby forming a first compartment 31.

The bottom base 9 forms a second cavity 33, in which as will be seen, the second mechanical pole of the circuit breaker is mounted. As in the case of the first cavity 29, the second cavity 33 includes molded elements for supporting the second mechanical pole.

The bottom base 11, forms a second partition 35 defining a third cavity 37. The bottom base 11 mates with the second cover 9 so that the second partition 35 encloses the second cavity 33 to form the second compartment 39, as shown in FIG. 2.

The hollow center base 13, mates with the bottom base 11 and the top base 5, to form with the cavity 37, a third compartment 41 between the first partition 27 and the second partition 35. (See FIG. 2).

Referring to FIG. 2, the width $W_3$ of the third compartment 41 as measured perpendicular to the partitions 27 and 35 is essentially twice the widths $W_1$ and $W_2$ of the first compartment 31 and second compartment 39. This provides a large contiguous space for the electronic trip circuits.

Figure 4:
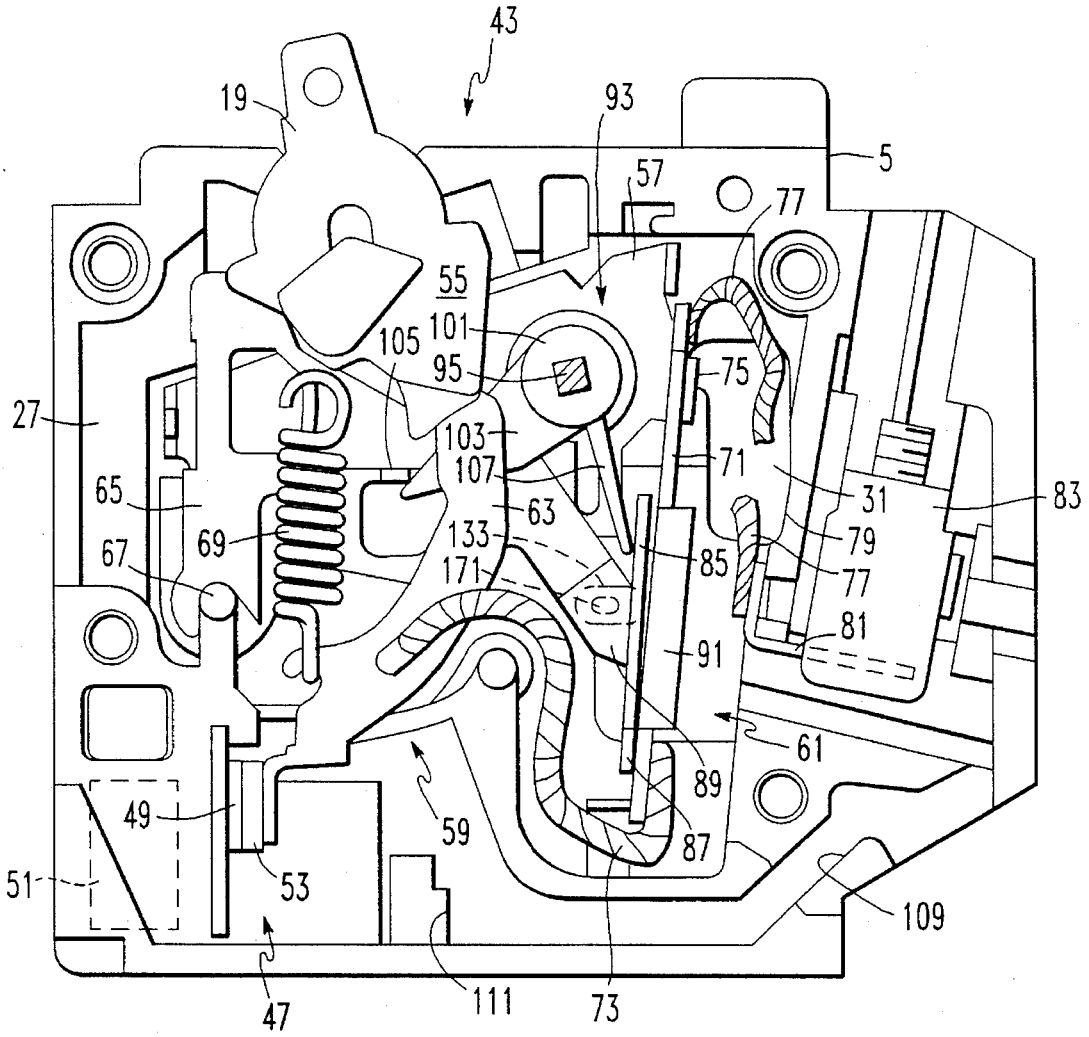
FIG. 4 is a vertical sectional view taken along the line 4—4 in FIG. 1 of the mechanical poles shown in the closed position.

As shown in FIGS. 3A, 3B and 4, the first and second mechanical poles 43 and 45 are located in the compartments 31 and 39, respectively. As the mechanical poles are similar to those utilized in U.S. Pat. No. 3,999,103, which is hereby incorporated by reference, they will only be described generally. Each of these mechanical poles 43 and 45 has a set of separable contacts 47 including a fixed contact 49 connected to a line terminal 51 and a moveable contact 53. The mechanical poles 43 and 45 further include a thermal-magnetic operating mechanism 55. The thermal magnetic operating mechanism 55 includes a supporting metal frame 57, an operating mechanism 59 and a trip device 61.

Briefly, the operating device 59 includes a contact arm 63 carrying the moveable contact 53 at a lower end and a cradle 65 pivoted about the molded pivot point 67 in the base 5 and bottom cover 9, respectively. The contact arm 63 is connected to the cradle 65 by a helical tension spring 69. The upper end of the contact arm 63 is engaged by the handle 19 or 21. Movement of the handle to the on position as shown in FIG. 4 rotates the contact arm 63 to close the separable contacts 47. When the handle, such as 21 is moved to the off position, the contact arm 63 rotates away from the fixed contact 49 to open the separable contacts 47.

The contact arm 63 is electrically connected to the lower end of an elongated bi-metal element 71 by flexible conductor 73. The bi-metal 71 is part of the trip device 61 and is secured at its upper end to a flange 75 on the frame 57. A flexible line conductor 77 connected to the upper end of the bi-metal 71 of the pole 43 passes through an opening 79 in the first partition 27 into the third or electronics compartment 41 and returns to the first compartment 31 back through the opening 79 and is connected to a tang 81 engaging a load connector 83. The flexible conductor 77 on the mechanical pole 45 passes through the opening 80 (See FIG. 6) in the partition 35 into the compartment 41 and returns through the same opening. Thus, a closed circuit through the mechanical poles 43 and 45 extends from the line terminal 51 through the fixed contact 49, the moveable contact 53, the contact arm 63 the flexible conductor 73, the bi-metal element 71, the flexible load conductor 77, and the tang 81 to the load connector 83.

The trip device 61 includes the bi-metal element 71, an elongated rigid magnetic armature or latch members 85 secured to the lower end of the bi-metal 71 by a flexible metal strip 87, and a finger 89 on the cradle 65.

As is well known in this type of circuit breaker, the magnetic armature 85 has an opening (not shown) which defines a latch surface on which the finger 89 of the cradle 65 is latched when the mechanical pole is reset by moving the handle slightly past the off position.

When the circuit breaker is in the on position as shown in FIG. 4 and an overload current above a first predetermined value is sustained, the bi-metal 71 is heated by the current flowing therethrough and deflects counterclockwise as seen in FIG. 4 to unlatch the finger 85 of the cradle whereupon the spring 69 trips the contact arm to a trip position (not shown) to open the separable contacts 47. When a short circuit occurs with the circuit breaker in the on position, the current generates a magnetic field which is channeled by a U-shaped piece 91 mounted on the bi-metal which attracts the magnetic armature toward the pole piece to unlatch the cradle and thereby trip the separable contacts open.

A common trip device 93 insures that when one mechanical pole trips, the other pole trips simultaneously. This common trip device 93 includes a shaft 95 extending through the third compartment 41, an opening not shown in partition 27, an opening 99 in partition 35 (See FIG. 6) into the first compartment 31 and second compartment 39. On each end of the shaft 95 is an actuating member 101. The actuating member 101 has a first leg 103 disposed adjacent a flange 105 on the cradle of the associated operating mechanism and a second leg 107 which is adjacent the magnetic armature or latch member 85. When one of the poles of the circuit breaker trips, the associated cradle 65 engages the first leg 103 and rotates the shaft 95. This rotates the actuating member 101 on the other end of the shaft 95 so that the second leg 107 of that actuating member engages the associated magnetic armature or latch member 85 to unlatch the cradle 65 and trip the other pole.

When either of the mechanical poles 43 or 45 trips in response to a short circuit, an arc is struck between the opening moveable contact 53 and fixed contact 49. This generates gases which are vented through the gas vent 109 molded into the housing 3. This is satisfactory for miniature circuit breakers with a current rating up to about 15 amps; however, when attempts have been made to increase the current rating, for instance up to about 50 or 60 amps, which requires the ability to interrupt currents of 5,000 to 10,000 amps, the vents 109 proved to be inadequate to release the generated gases rapidly enough to avoid a pressure buildup within the compartment housing the tripped pole to such a magnitude that the housing was blown apart.

In order to avoid this problem, a gas channel 111 is molded into the housing 3 to connect the compartments 31 and 39 containing the first and second mechanical poles 43 and 45. This gas channel 111 has a first section 111A formed in the first partition 27 of the top base 5, a second section 111B formed in the second partition 35 of the bottom base 11, and a third section 111C formed in the hollow center base 13. Thus, the gas vent 111 extends through the third electronics compartment 41 without communicating therewith.

The gas vent 111 communicates with the first compartment 31 and the second compartment 39 adjacent the separable contacts 47. Thus, the gases generated by the arc during interruption of a short circuit current in one pole can pass through the channel 111 so that the volumes of the two compartments 31 and 39 are shared and the gas pressure is reduced.

In addition to the thermal-magnetic poles 43 and 45, the circuit breaker 1 includes an electronic trip device 112. This electronic trip device 112 provides ground fault protection. A suitable ground fault protection device 112 is disclosed in U.S. Pat. No. 5,260,676 which is hereby incorporated by reference. As mentioned above, the circuit breaker disclosed in U.S. Pat. No. 5,260,676 has four compartments with the circuitry for the electronic trip located in two compartments separated by one of the mechanical poles. As also mentioned above, the circuit breaker 1 of the present invention provides a large center compartment 41 in which all of the components of the electronic trip device 112 are located. The printed circuit board (PCB) 113 on which the electronic circuit for the ground fault protection is mounted is supported in the compartment 41 against the partition 27 of the top base as seen in FIG. 2. The ground fault trip device is of the dormant oscillator type and utilizes a pair of toroidal sensing coils 115 and 117. These two coils are stacked one on top of each other within the compartment 41 with a common central axis 119 parallel to the partitions 27 and 35 defining the walls of the compartment. The flexible load conductor 77 of the first mechanical pole 43, which as discussed above extends from the hi-metal element 71 to the tang 81, passes through the opening 79 in the partition 27 into the compartment 41 and extends through the toroidal coils 115 and 117. Likewise, the flexible load conductor 77 of the second mechanical pole 45 extends from the bi-metal 71 through the opening 80 in the partition 35 of the bottom base 11, passes through the toroidal coils 115 and 117, back through the opening 80 and is connected to a tang 81. A neutral conductor 123 also passes through the two toroidal coils 115 and 117 in a manner discussed in the U.S. Pat. No. 5,260,676. One end of the neutral conductor 123 is connected to the pigtail 17 and the other end is connected to a tang 125 of a load end neutral connector 121.

The electronic trip circuit 112 includes a dual wound solenoid 127 mounted on the printed circuit board 113. One of the windings on the dual wound solenoid 127 is energized when the ground fault is detected in the first mechanical pole 43 and the other is energized in response to a ground fault on the second pole 45. Energization of either winding results in the extension of the plunger 129. A finger 131 (See FIG. 8) on the plunger 129 extends through an opening 133 in the partition 27, so that energization of the solenoid 127 results in tripping of the first mechanical pole 43. As explained above, the second mechanical pole 45 is simultaneously tripped by the common trip device 93. The test button 25 is actuated by a spring biased by a resilient copper conductor 133 in a manner discussed in U.S. Pat. No. 5,293,522. Various leads 137 engage plugs 139 on the circuit board 113.

In assembling the circuit breaker 1, the mechanical poles 43 and 45 are inserted in the top base 5 and the bottom cover 11, respectively. The bottom base 9 must then be placed over the bottom cover 11 to enclose the second mechanical pole 45. However, as can be appreciated from FIG. 3B, the second pole load terminal connector 83, which is captured between the bottom cover 9 and the bottom base 11, must be connected to the load conductor 77 which, as discussed above is routed through the toroidal coils 115 and 117 in the electronics compartment 41. In addition, the toroidal coils must be held in a fixed position while the remainder of the housing is assembled. Also, the various leads 137 must be connected to the printed circuit board 113, and the load side conductor 77 of the first mechanical pole must be connected as described. Furthermore, the connection of the neutral conductor 123 to pig tail 17 and to a tang 125 which is captured between the hollow center base 13 and the top base 5 must be made.

In order to alleviate the difficulty of maintaining all of these various parts and leads in place while the molded sections of the housing are assembled, the load conductor 77' for the second mechanical pole 45 and the neutral conductor 123 are stiff conductors rather than the typical braided wire conductors. Thus, these conductors 77' and 123 are preformed from insulated solid copper wire, such as for example 12 awg or 14 awg solid copper wire UL rated at 105° C. at 300 volts which have permitted a rating of 60 amps in the exemplary circuit breakers in spite of limited space available in the circuit breaker.

As shown in FIGS. 7–9, the stiff, solid wire load conductor 77' is preformed into a configuration which includes a vertically oriented bight 141 in the center portion of the conductor. One end 143 of the conductor 77' has a horizontal section 145 extending from the bight 141, with a stripped terminal portion 147 bent at about a 45° angle to the section 145. A tang 81 is brazed to the stripped terminal portion 147. The second end 149 of the stiff load conductor 77' has a section 151 bent at about a 45° angle to the vertical with the tip 153 bent to extend horizontally in the direction opposite to the terminal portion 147. One of the leads 137 is also brazed to the tang 81.

The stiff conductor 123 preform is illustrated in FIGS. 10–12. This preform has a vertical section 153, an upper intermediate horizontal section 157 and an upper horizontal terminal portion 159 which is substantially at right angles to the section 157. A tang 125 is brazed to this terminal portion 159 together with the printed circuit board lead 137. At the lower end of the vertical section 155 is a short horizontal section 161 which is substantially perpendicular to the upper horizontal section 157. This lower portion of the preform 123 is then bent in a horizontal plane to form a section 163 which is substantially parallel to the upper horizontal section 157. A terminal portion 165 then extends upward at an angle of about 45° for a purpose to be explained. This terminal section 165 is vertically aligned with the tang 81.

Figure 5:
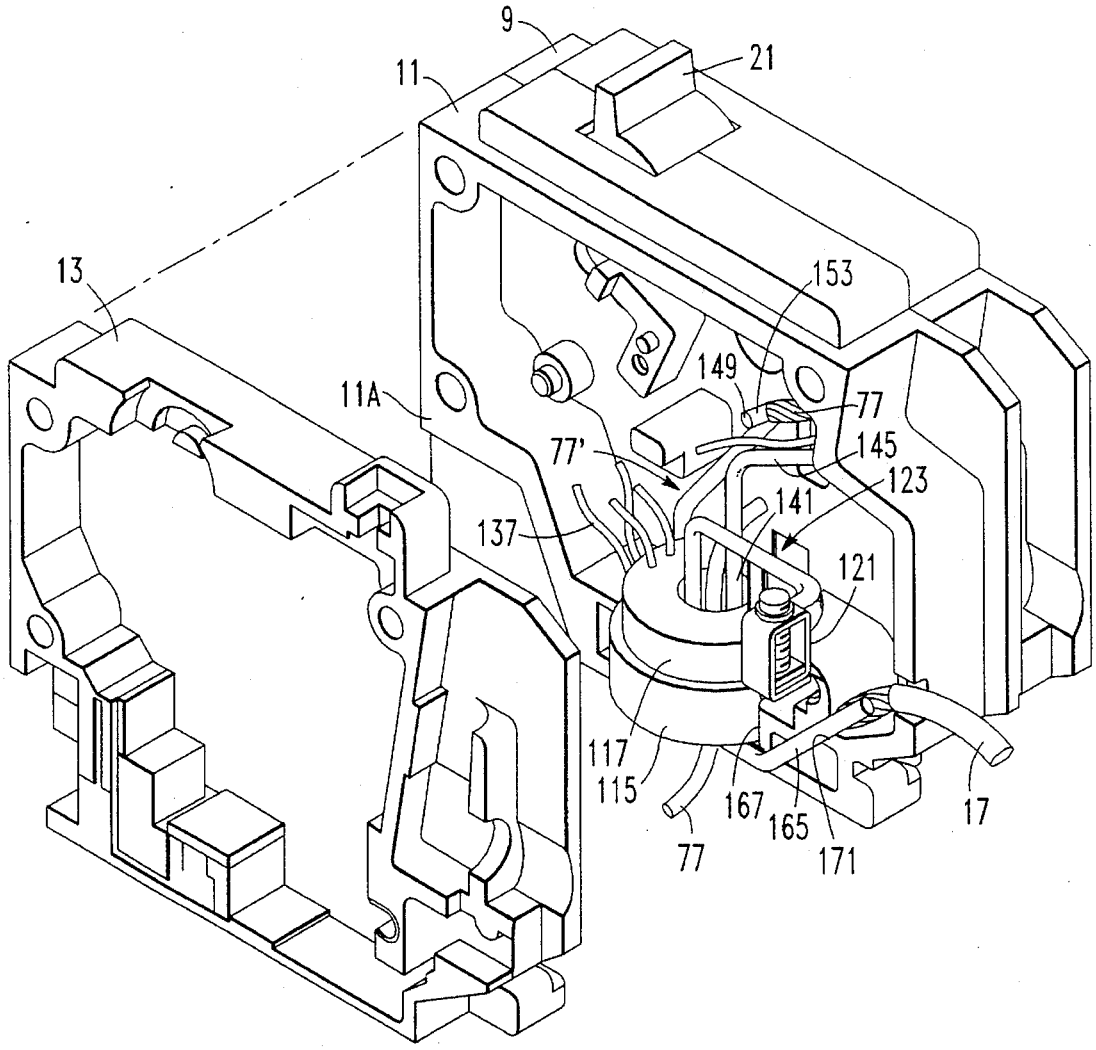
FIG. 5 is an isometric view of the circuit breaker of FIG. 1 partially assembled.
Figure 6:
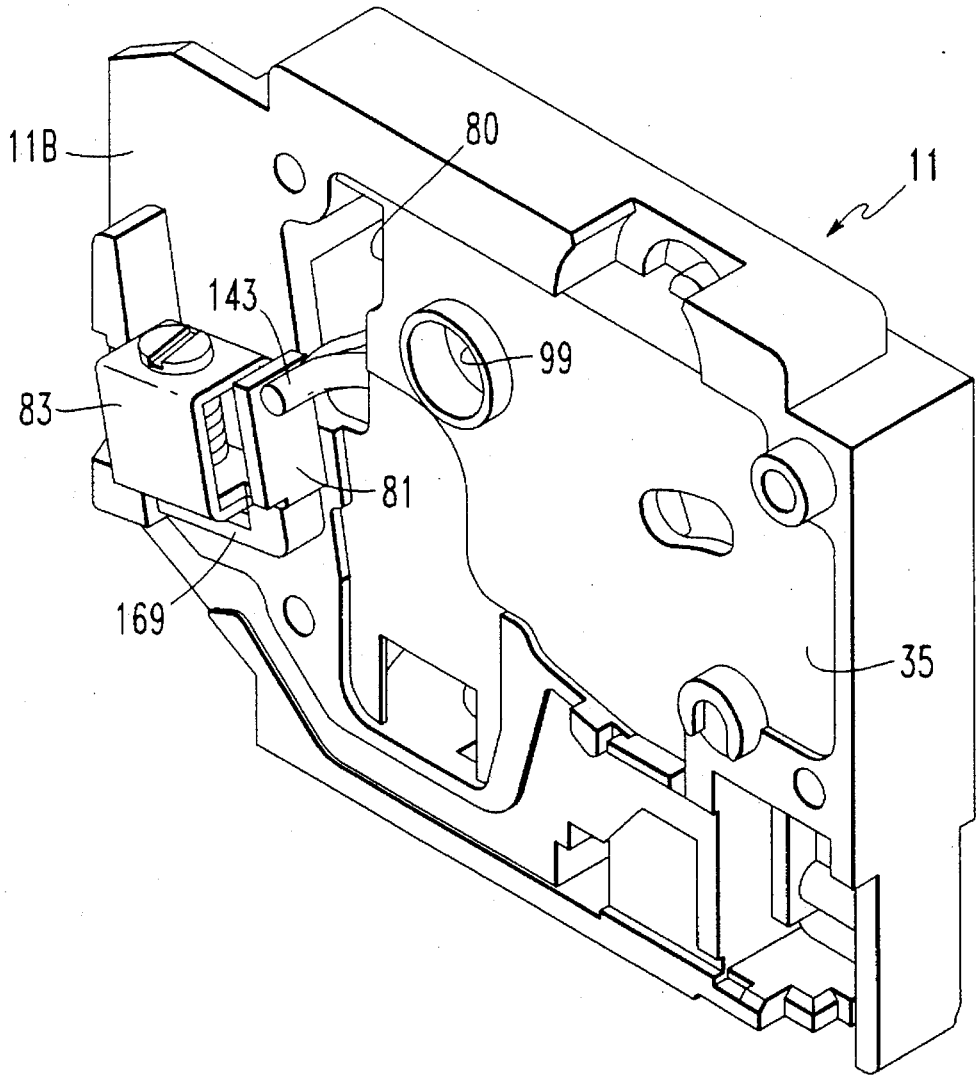
FIG. 6 is an isometric view of the opposite side of the first molded section shown in the partial assembly of FIG. 3.

Turning to FIGS. 5 and 6, the preformed stiff conductor 77' is inserted through the stacked toroidal coils 115 and 117 so that the coils are supported in the bight 141. The preformed stiff conductor 123 is also inserted through the stacked toroidal coils so that the center vertical section 155 extends axially through the coils. The coils 115 an 117, with the preformed stiff conductor 77' and 123 extending therethrough, are seated in a recess 167 molded into the first side **11*a* of the bottom base 11. The one end 143 of the stiff conductor 77' extends through the opening 80 in the lower base 11 and the tang 81 is secured in the second pole load connector 83 which is snugly retained in a connector recess 169 molded into the second side 11*b* of the bottom base 11 (See FIG. 6). This secures the coils 115 and 117 to the bottom base 11 to form a unit which can be handled as a single piece. At this point, the lower base 11 may be seated on the lower cover 9 to enclose the second mechanical pole 45. As this occurs, the load connector 81 for the second pole remains properly positioned for mating of the pans 9 and 11. The flexible conductor 77 connected to the upper end of the bi-metal of the second pole extends through the opening 80 and is brazed to the tipper end 149 of the preformed stiff conductor 77'**.

At this point, the preformed stiff conductor 123 is free to be rotated about the center section 155 which extends through the toroidal coils. The pigtail 17 is then brazed to the lower terminal section 165 of the stiff conductor 123 and the conductor 123 is rotated about the center section 155 to seat the terminal section 165 and the connected end of the pigtail 17 in a groove 171 molded into the bottom base 11. This also rotates the upper end section 159 of the conductor 123 to bring the tang 125 secured to the connector 121 into position for capture between the hollow center base 13 and the top base 5 as can be appreciated from FIG. 3A.

The load conductor 77 for the first pole 43 remains a flexible conductor which is inserted through the toroidal coils 115 and 117 along with the preformed stiff conductors 77' and 123. After the hollow center base 13 is placed over the bottom base 11, and the top base with the printed circuit 113 installed on one side and the first mechanical pole on the other side, is mated with the hollow center base 13. The one end of the flexible load conductor 77 is then brazed to the upper end of the bi-metal on the first mechanical pole and the other end having a tang 81 brazed thereto is connected to the first pole load connector 83. The top cover 7 is then placed over the top base 5 and the rivets 15 are inserted to complete assembly.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a molded housing having compartments including an electronic compartment and assembled from a plurality of molded housing sections;

circuit interrupting means including electronic trip means received in said electronic compartment; and stiff conductor means secured at one end to one molded housing section forming at least part of said electronics compartment and engaging and holding said electronic trip means in a fixed position with respect to said one molded housing section while said plurality of molded housing sections are assembled to form said molded housing.

2. The circuit breaker of claim 1 wherein said molded housing further includes a connector recess in said one molded housing section, wherein said circuit interrupting means includes a first connector snugly engaged in said connector recess, and wherein said stiff conductor means is secured to said first connector.

3. The circuit breaker of claim 2 wherein said electronic trip means comprises toroidal coil means and said stiff conductor means passes through said toroidal coil means and is configured to hold said toroidal coil means in said fixed position.

4. The circuit breaker of claim 3 wherein said stiff conductor means comprises a first stiff conductor configured with a bight and said toroidal coil means is held in said bight.

5. The circuit breaker of claim 4 wherein said molded housing includes a mechanical pole compartment next to said electronics compartment and having an opening connecting said mechanical pole compartment and said electronics compartment, wherein said circuit interrupting means includes a mechanical pole in said mechanical pole compartment and having an electrical conductor extending through said opening, and wherein said first stiff conductor is connected at a second end to said electrical conductor as said sections of said housing are assembled.

6. The circuit breaker of claim 4 wherein said stiff conductor means further comprises a second stiff conductor also extending through said toroidal coil means, said one molded housing section having a groove in which a first end of said second stiff conductor is seated and said second stiff conductor having a second end with means for engaging a second connector and positioned by seating of said first end in said groove for engagement with said second connector as said molded housing sections are assembled.

7. The circuit breaker of claim 4 wherein said one molded housing section has a first side and a second side with an opening between said first side and said second side, said first side having a coil recess in which said toroidal coil means seats, said second side having said connector recess in which said connector is snugly engaged and wherein said one end of said first stiff conductor extends through said opening.

8. The circuit breaker of claim 7 wherein said molded housing includes a mechanical pole compartment next to said electronics compartment and formed by said second side of said one molding housing section and an adjacent molded housing section, said opening connecting said electronics compartment and said mechanical pole compartment, said circuit interrupting means including a mechanical pole in said mechanical pole compartment and having an electrical lead extending through said opening, and wherein said first stiff conductor is connected at a second end to said electrical conductor as said sections of said molded housing are assembled.

* * * * *